US006749161B1

(12) United States Patent
Will et al.

(10) Patent No.: US 6,749,161 B1
(45) Date of Patent: Jun. 15, 2004

(54) SLATWALL MOUNTING BRACKET

(75) Inventors: Bryon James Will, Holland, MI (US); Dale J. Cavanaugh, Bremerton, WA (US); Richard Theophilus Gumpert, IV, Salem, VA (US)

(73) Assignee: Windquest Companies, Inc., Holland, MI (US)

( * ) Notice: Subject to any disclaimer, the term of this patent is extended or adjusted under 35 U.S.C. 154(b) by 0 days.

(21) Appl. No.: 10/324,903

(22) Filed: Dec. 20, 2002

(51) Int. Cl.[7] ..... A47F 1/00

(52) U.S. Cl. ..... 248/222.51; 248/220.31; 211/57.1; 211/59.1

(58) Field of Search ..... 248/220.22, 220.31, 248/222.51, 223.41, 224.7, 225.11, 235, 247, 221.11, 224.51, 224.61; 211/57.1, 59.1, 90.01; 40/642.01

(56) References Cited

U.S. PATENT DOCUMENTS 1,794,700 A * 3/1931 McCaskey ..... 248/224.51
3,677,415 A * 7/1972 Radek ..... 248/220.42
3,912,084 A * 10/1975 Valiulis ..... 248/220.22
4,351,440 A * 9/1982 Thalenfeld ..... 211/57.1
4,678,151 A * 7/1987 Radek ..... 248/223.41
4,882,868 A * 11/1989 Fast ..... 40/642.01
5,080,238 A * 1/1992 Hochman ..... 211/59.1
5,088,606 A * 2/1992 Boas ..... 211/57.1
5,375,725 A * 12/1994 Rosenthal ..... 211/59.1
5,941,485 A * 8/1999 Davidson et al. ..... 248/218.4
5,984,118 A * 11/1999 Morrow ..... 211/59.1

* cited by examiner

*Primary Examiner*—Leslie A. Braun
*Assistant Examiner*—Jon Szumny
(74) *Attorney, Agent, or Firm*—Warner Norcross & Judd

(57) ABSTRACT

A slatwall bracket assembly, including a base plate for mounting on a slatwall and a removable cover for locking the base plate on a slatwall. When installed, the cover extends above the slatwall groove to prevent inadvertent or otherwise unwanted rotation of the bracket. In a preferred embodiment, the cover is a rectangular planar body that has a vertical length longer than that of the base plate, such that the cover fits over the entire length of the base plate, with an additional portion that extends above the base plate. Also in the preferred embodiment, the cover is slidable over the base plate.

4 Claims, 4 Drawing Sheets

SLATWALL MOUNTING BRACKET

BACKGROUND OF THE INVENTION

The present invention relates generally to mounting fixtures and more particularly to a mounting bracket for a "slatwall," which is a wall provided with elongated horizontally extending grooves.

Slatwall is used in a wide variety of applications for storing and displaying products, tools, and accessories. Examples of the industries in which slatwall is used include retail display, closet storage, and office furniture. As is well known, a slatwall is a wall panel formed from metal, pressed board or other suitable material into which a plurality of regularly spaced, horizontally extending grooves of L-shaped or T-shaped cross section are formed. Various different accessories such as brackets, shelves, baskets, and the like are available which are specially designed for fitting into the grooves of the slatwall so that items can be conveniently hung or otherwise supported thereon.

A typical slatwall-mounting bracket includes a flat base plate and some type of cantilever element for fitting into one of the groves. The cantilever element is generally an L-shaped hook that extends perpendicularly from the base plate and then forms a corner that turns upwards. The base plate generally lies flat against the slatwall, so that accessories such as hooks, racks, and shelves can be attached to its outer face. The L-shaped hook fits into a slatwall groove such that the vertical portion of the hook bears against the inner surface of the groove, and the horizontal portion sits on the lower groove ledge.

In operation, the slatwall bracket is manually hung from a desired groove on the slatwall. First, the L-shaped hook is inserted into the opening of a slatwall groove with the base plate oriented perpendicularly to the slatwall. The corner portion of the hook is then rotated about the slatwall groove ledge until the hook fully engages the groove and the base plate bears against the front surface of the slatwall. Once the bracket is hung, any desired accessory can be attached to the base plate. Alternatively, some brackets are permanently attached to a particular accessory, which may be used as soon as the bracket is hung. In some cases, a plurality of slatwall brackets are used in combination to support accessories too large or heavy for a single bracket.

Unfortunately, conventional slatwall brackets can be relatively easily inadvertently dislodged from the slatwall after installation. While conventional brackets remain in position well under load, they are easily moved when subjected to upward forces. The same rotation that allows the bracket to be easily installed in the slatwall also allows the bracket to rotate away from the wall when a force pulls on the bracket. In a worst case scenario, a person may accidentally knock a bracket and any attached accessory completely off the wall if a force is applied in the wrong direction.

SUMMARY OF THE INVENTION

The aforementioned problems are overcome by the present invention, wherein a slatwall bracket is provided with a removable cover that slides over the base plate to prevent unwanted or inadvertent dislodgment of the bracket. The cover extends above the top edge of the base plate to prevent rotation of the bracket. Consequently, any potentially dislodging force simply presses the cover against the slatwall without rotation.

The bracket is installed on the slatwall in the conventional manner, and then the cover is placed over the planar body such that the cover extends above the groove opening in which the bracket was inserted. The inside face of the cover extension bears against the face of the slatwall to prevent any rotation of the bracket.

In a preferred embodiment, the cover is a rectangular planar body that has a vertical length longer than that of the base plate, such that the cover fits over the entire length of the base plate in addition to extending above the base plate.

In another preferred embodiment, the cover is slidable over the base plate. More specifically, the horizontal cross section of the base plate is T-shaped, and the horizontal cross section of the cover is C-shaped, such that after the bracket is installed, the cover can slide over the base plate with the C-shaped cover wrapping around the ears of the T-shaped base plate, holding the cover in place. Two small ledges near the top of the inside of the cover engage the base plate to properly position in the installed position, ensuring that a portion of the cover extends above the top of the base plate.

In a further preferred embodiment, the cover includes some type of accessory attachment, enabling a variety of conventional accessories to be attached to and hung from the cover. This avoids any purchase or remanufacturing of modified slatwall accessories, making the present invention easily adaptable to exiting slatwall accessories.

These and other objects, advantages, and features of the invention will be readily understood and appreciated by reference to the detailed description of the preferred embodiment and the drawings.

DETAILED DESCRIPTION OF THE PREFERRED EMBODIMENT

I. Overview

Figure 1:
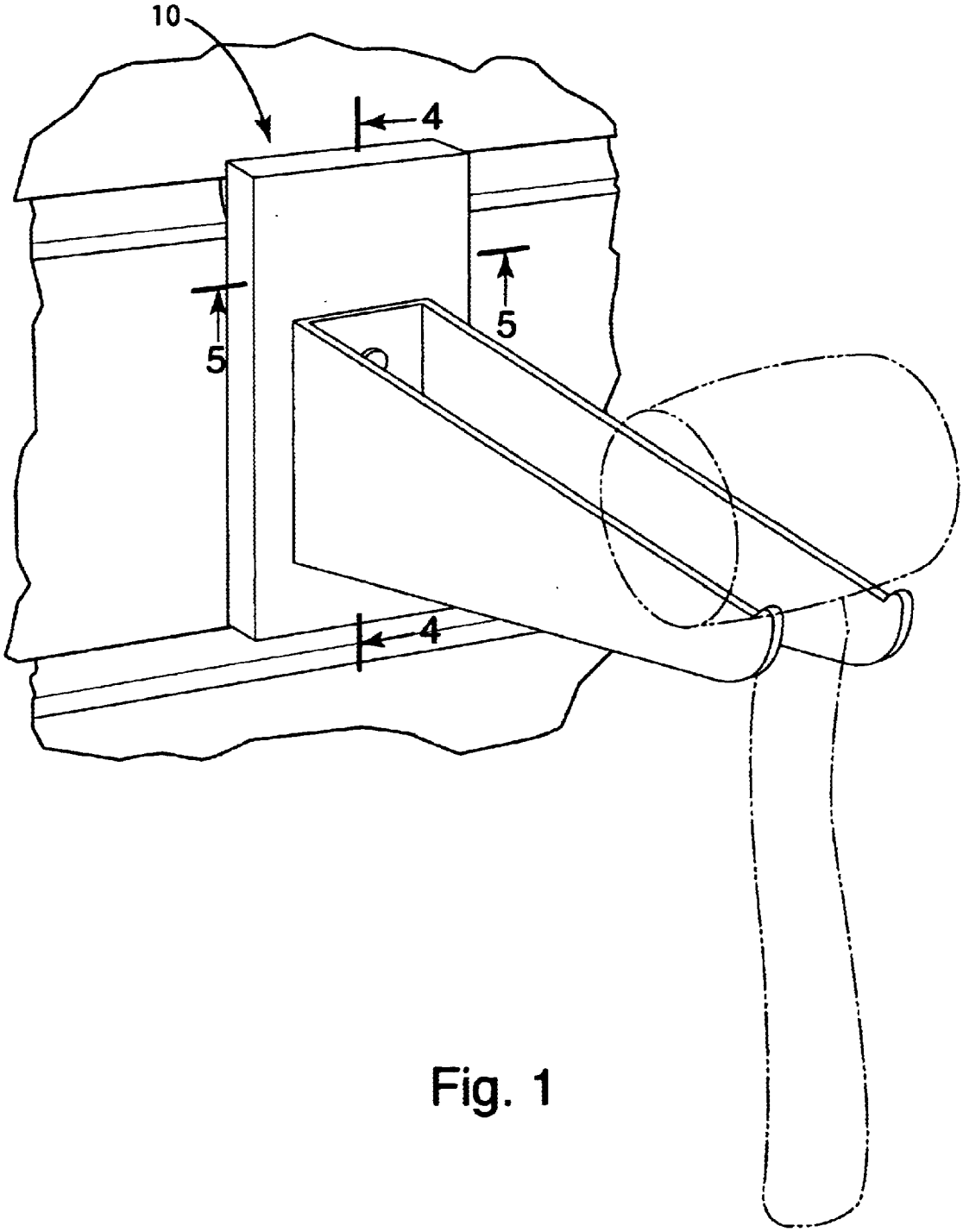
FIG. 1 is a perspective view of the mounting bracket of the present invention installed on a slatwall with an accessory attached.
Figure 2:
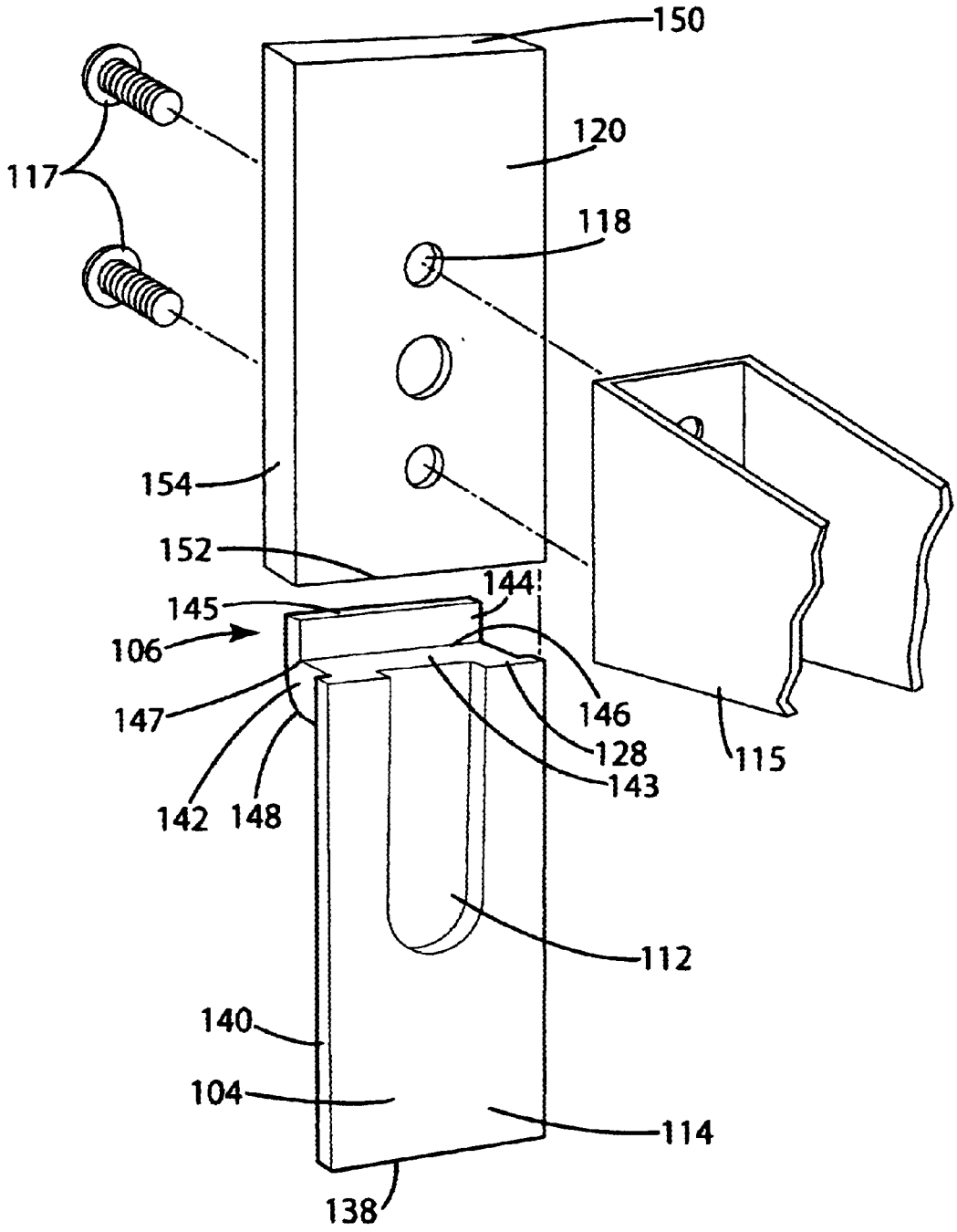
FIG. 2 is a perspective exploded view of the bracket.

A slatwall bracket assembly in accordance with a preferred embodiment of the present invention is shown in FIGS. 1 and 2 and is generally designated 10. The assembly includes a bracket 100, a cover 102, and an accessory 115. In a preferred embodiment, the bracket 100 includes a base plate 104, and a mounting flange 106. The cover 102 is removable, and slides over the base plate 104. The horizontal cross sections of the cover 102 and the base plate 104 are designed so that the cover 102 and base plate 104 interlock when the cover 102 is fully installed. The cover 102 includes accessory attachment holes 118 extruded through it, to allow the attachment of a variety of accessories 115. The base plate 104 includes a cutaway 112 on its outer face 114 to allow space for accessories 115 attached to the cover 102.

Figures 4, 5:
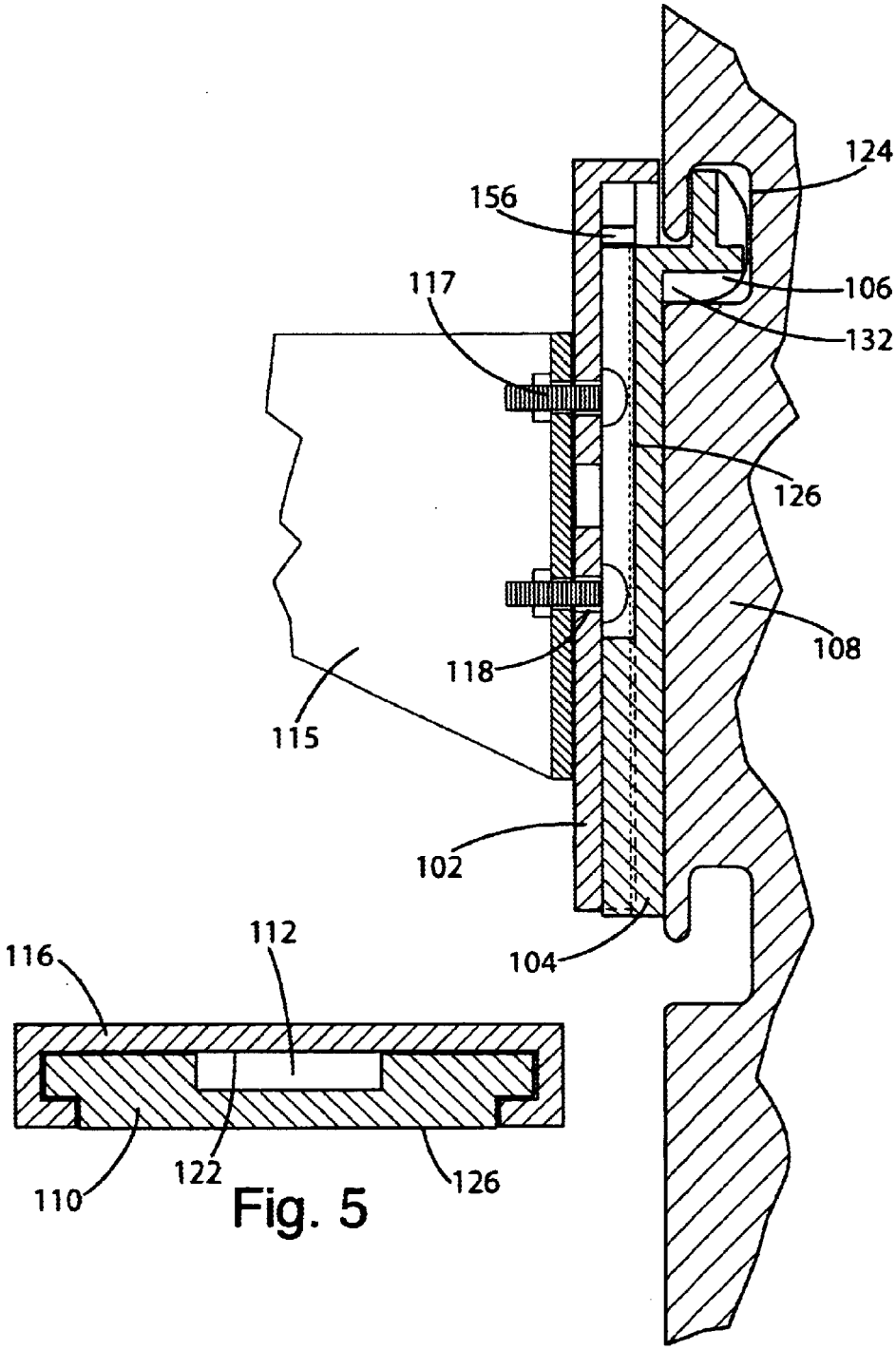
FIG. 4 is a vertical cross sectional view taken along line 4 of FIG. 1.
FIG. 5 horizontal cross sectional view taken along line 5 n FIG. 1.

In operation, the flange 106 on the bracket 100 is inserted into a slatwall groove 124 (shown in FIG. 3), and rotated in position to hang the bracket 100 on the slatwall 108. Referring to FIG. 4, the cover 102 is then slid over the base plate 104 of the bracket 100 such that a portion of the cover extends above the groove opening 132. A desired accessory 115 is attached to the cover 102, preferably before installation but possibly after installation, using nut and bolts 117 through accessory holes 118. In some cases, the accessory 115 is simply a hook for hanging another item, such as the tool shown in FIG. 1.

II. Structure

Figure 3:
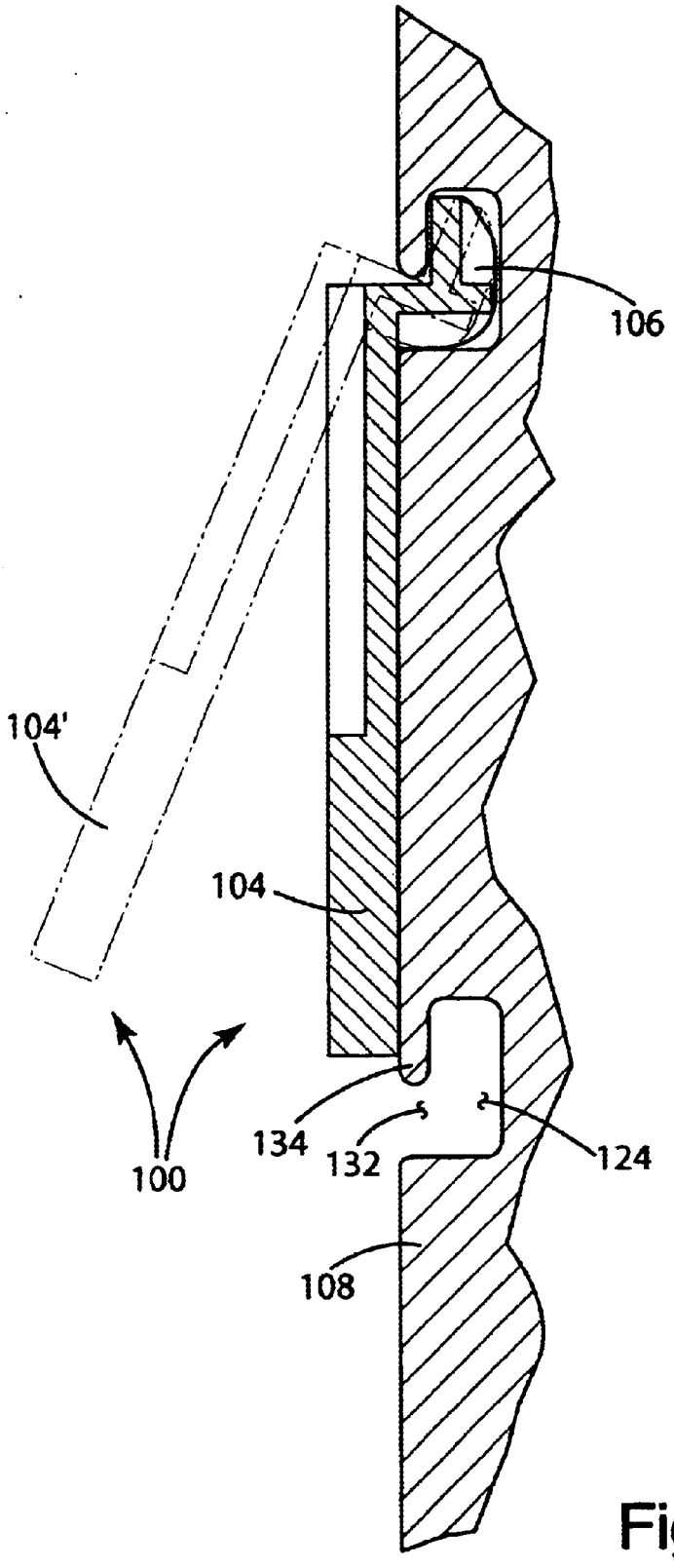
FIG. 3 is a vertical cross sectional view of the slatwall and base plate taken along line 4 in FIG. 1 with a pre-install position illustrated in phantom.

As noted above, the slatwall bracket assembly 10 is mounted on the slatwall 108. FIG. 3 shows how the flange 106 engages the slatwall groove and the base plate 104 lies flat against the slatwall 108 when installed. As noted above, slatwall 108 is widely known and therefore will not be discussed in detail here. In short, slatwall 108 is generally made from pressed board such as medium density fiberboard (MDF), or from extruded metal such as steel or aluminum. Shown in FIG. 3, slatwall 108 is a wall consisting of vertically spaced horizontal grooves 124. Each slatwall groove 124 includes an opening 132, and a ledge 134.

As shown in FIG. 2, the bracket 100 includes a base plate 104 and a mounting flange 106. The base plate 104 is generally a rectangular, planar body that includes an inner face 126 (not shown) that bears against the slatwall 108, an outer face 114 that opposes the inner face 126, a top edge 128, a bottom edge 138, and side edges 140. The base plate 104 defines a T-shaped horizontal cross section 110 such that the ears of the "T" form vertical notches in the side edges 140, which extend the length of the base plate 104 from the bottom edge 138 to the top edge 128 and approximately half the depth of the base plate 104 from the inner face 126 towards the outer face 114. This cross section 110 is designed to accommodate the sliding cover 102 when the bracket assembly 10 is fully installed. In addition, the outer surface 114 of the base plate 104 includes a cutout 112 to accommodate for the nuts and bolts 117 used to attach any accessories 115 through the cover 102. The cutout 112 is generally a rectangular notch that may include an arc at the bottom. The cutout 112 extends approximately half the length of the base plate 104 from the top edge 128 to the bottom edge 138 and approximately half the depth of the base plate 104 from the outer face 114 towards the inner face 126.

The mounting flange 106 is generally an L-shaped cantilever element that is conventionally attached to the base plate 104, and includes a horizontal member 142 and a vertical member 144. In a preferred embodiment, the flange 106 is positioned such that the first member 142 attaches normal to the base plate 104. The upper surface 143 of the first member 142 is generally flush with the top edge 128 of the base plate 104. In a preferred embodiment, the length of the first member 142 is approximately equal to the depth of the slatwall ledge 134. The second flange member 144 attaches normal to the first member 142, forming a 90-degree corner 146. The upper surface of the corner 146 defines a square edge 147, but the lower surface defines a radius 148 for rotating the bracket into the slatwall 108 during installation. The top edge 145 of the second member 144 is parallel with the top edge 128 of the bracket 100.

The cover 102 is generally rectangular in shape, with dimensions such that it fits over the base plate 104, but has a substantially longer vertical dimension than the base plate 104. Referring now to FIGS. 2 and 5, the cover 102 preferably includes an inner face 122 that bears against the base plate 104, an outer face 120, a top edge 150, a bottom edge 152, and side edges 154. The horizontal cross section 116 of the cover 102 is C-shaped, forming opposing grooves that are capable of sliding over the ears of the T-shaped base plate 104. The C-shaped cross section extends from the bottom edge 152 of the cover 102 to the top edge 150, except that the top edge 150 is closed off to form a flat surface. In addition, the horizontal cross section 116 includes opposing ledges 156 near the top of the cover 102 that prevent the cover 102 from sliding down too far over the base plate 104, and ensure that a portion of the cover stands above the top edge 128 of the base plate 104. When installed, the cover 102 is fit over the base plate 104 such that the C-shaped cross section 116 of the cover 102 engages the T-shaped cross section 110 of the base plate 104. The ledges 156 of the cover rest on the top edge 128 of the base plate 104, with a portion of the cover 102 extending above the base plate 104.

The cover 102 further includes accessory holes 118 for attaching accessories 115 to the cover 102. In a preferred embodiment, the cover 102 defines a three vertically disposed holes passing through the outer and inner faces 120, 122 of the cover 102. The outer holes 118 are generally smaller than the center hole, such that the outer holes accommodate a typical center nut and bolt, and the center hole accommodates a typical weld nut and bolt. The differing hole sizes allow attachment of a variety of desired accessories 115. As noted above, the base plate 104 includes a cutout 112 on its outer face 114 to allow adequate space for a nut in between the base plate 104 and cover 102.

III. Operation

In a preferred embodiment, the present invention is mountable onto conventional slatwall 108 in a few simple steps, while accommodating a variety of accessories 115 and preventing unwanted rotation and movement. Installation of the present invention requires first hanging the bracket 100 on the slatwall 108, followed by sliding the cover 102 over the base plate 104 and then attaching any accessories 115.

The first step of installing a slatwall bracket in accordance with the present invention is hanging the bracket 100 on the slatwall 108. To begin, a desired height and location on the slatwall 108 are chosen. The bracket 100 is then held manually such that the base plate 104 is perpendicular to the slatwall 108, with the top edge 145 of the flange 106 aligned with the opening 132 of the chosen horizontal slatwall groove 130. The flange 106 is then inserted in to the opening 132 and the flange corner 146 is rotated about the ledge 134 until the vertical member 144 of the flange 106 bears against the inner surface of the ledge 134. FIG. 3 shows the rotation of the bracket 100 with the base plate 104 in an intermediate position 104' and a final position 104. In this final position, the base plate 104 is parallel with and bearing against the slatwall 108.

Once the bracket 100 is in place, the cover 102 can be attached. In a preferred embodiment, the cover 102 is manually held over the base plate 104 of the installed bracket 100 such that the C-shaped cross section 116 of the bottom of the cover 152 is aligned over the T-shaped cross section 110 of the base plate 104. The cover 102 is then slid down over the base plate 104, with the ears of the base plate cross section 110 engaging the C-shaped cover 116 to secure the cover 102. The cover 102 continues to slide onto the base plate 104 until the ledges 156 of the cover 102 meet the top edge 128 of the bracket 102. The bottom edge 152 of the cover 102 is preferably flush with the bottom edge 138 of the base plate 104, and the top edge 150 of the cover 102 is substantially higher than top the edge 128 of the base plate 104. When fully installed, a portion of the inner face 122 of the cover 102 bears against the slatwall 108 above the groove opening 132, such that the bracket assembly 10 cannot be rotated out of the slatwall 108 about corner 146.

A desired accessory 115 is mounted onto the cover 102. Conventional accessories 115 generally include nut and bolt attachments that enables them to be attached to the mounting holes 118. In a preferred embodiment, the accessory 115 includes either a center nut and bolt that fits the outer attachment holes 118, or a weld nut and bolt to fit the center attachment hole. In this embodiment, the accessory 115 must be attached to the cover before the cover 102 is placed on the bracket 100 so that the bolt can be accessed. In another embodiment, the accessory 115 is permanently attached to the a cover 102, such that a single piece including a cover and accessory can simply slide onto a bracket 100.

Removal of the slatwall bracket assembly 10 is essentially the opposite of installation. First, the cover 102 is slid vertically off the base plate 104 until it can be completely removed. Next, the bracket 100 is rotated out of the slatwall 108. When removing the bracket 100, the bottom 138 of the base plate 104 is pulled away from the slatwall 108 so that the flange corner 146 rotates about the slatwall groove ledge 134. This rotation is made easier by the radius 148 on the lower surface of the corner 146, which is frictionally engaged with the slatwall groove 124. Rotation is complete when the base plate 104 is again perpendicular to the slatwall 108, and the bracket 100 can then be removed from the groove 124.

In summary, once a desired height and location for placement of the accessory 115 are determined, the bracket assembly 10 can be attached to the slatwall 108 to hang the accessory 115 such that it will not be knocked off of the slatwall 108. First, the underlying bracket 100 is hung, followed by attachment of the cover 102 and any accessory 115.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A slatwall and mounting bracket system, comprising:

a slatwall panel, said panel including vertically spaced horizontal grooves;

a base plate including a generally planar body and a hook, said planar body including opposite edges and a recess including a depth approximate to half of that of the planar body, said hook being generally L-shaped and extending perpendicularly from said body, said hook including a first and second member, said first member extending normally from said planar body, said second member extending upward at a right angle from said first member, forming a corner with said first member; and a cover, said cover including a plurality of accessory attachment holes aligned with said recess, said cover slidable in a direction parallel to said body, said cover including opposed grooves that receive said edges of said body, said grooves including a ledge for supporting a portion of said cover above one of said slatwall grooves, said cover extending above said base plate when fully installed.

2. The mounting bracket of claim 1, wherein said corner includes an upper surface and a lower surface, said upper surface having a square edge and said lower surface having a radius.

3. A slatwall bracket, comprising:

a base plate including a planar body and a flange extending from said body, said planar body including opposing edges, said flange comprising an L-shaped hook including a first and second member, the first member extending normally from said body, and the second member extending upward, forming a corner with the first member, said corner including an upper and a lower surface, the upper surface having a square edge and the lower surface including a smooth radius; and a cover, said cover including opposed grooves that receive said opposing edges of said planar body, said cover movable to a locked position with a portion of said cover extending above said hook to prevent the base from being removed from a slatwall, said cover slidable onto said body and removable from said body, said cover sliding parallel to said body and including a ledge for supporting said portion of said cover above said hook, said cover including an outer face, said face provided with three accessory mounting holes, said holes capable of receiving a variety of conventional bolts.

4. The slatwall bracket of claim 3, wherein the planar body includes an outer face, said outer face including a recess that is aligned with said mounting holes to provide space for the attachment of an accessory through said holes.

* * * * *